US005377995A

United States Patent [19]

Clark

[11] Patent Number: 5,377,995

[45] Date of Patent: Jan. 3, 1995

[54] GAME APPARATUS

[76] Inventor: Nattkemper L. Clark, 5555 Montgomery Dr. #G104, Santa Rosa, Calif. 95409

[21] Appl. No.: 197,889

[22] Filed: Feb. 17, 1994

[51] Int. Cl.[6] ..... A63B 65/00

[52] U.S. Cl. ..... 273/327

[58] Field of Search ..... 273/327, 440, 58 C

[56] References Cited

U.S. PATENT DOCUMENTS

| | | | |
|---|---|---|---|
| 442,675 | 12/1890 | Wilcox | 273/327 |
| 2,120,075 | 6/1938 | Roosman | 273/327 |
| 2,408,160 | 9/1946 | Brunner | 273/440 |
| 3,049,352 | 8/1962 | Hancock | 273/327 |
| 4,805,916 | 2/1989 | Zentner, Jr. | 273/336 |

*Primary Examiner*—William H. Grieb

*Attorney, Agent, or Firm*—Larry D. Johnson

[57] ABSTRACT

A game apparatus includes a dual-bodied missile member which consists of two ball elements or other discrete masses connected to each other by a flexible strap portion, and a tossing/catching implement or stick member which is used in launching and receiving the missile. The missile bodies are preferably identical to each other in size, shape, and weight.

10 Claims, 4 Drawing Sheets

GAME APPARATUS

BACKGROUND OF THE INVENTION

1. Field of the Invention

This invention relates generally to games and sporting activities, and more specifically to an improved apparatus for a tossing and catching game.

2. Description of the Prior Art

Tossing and catching games are universally popular and take a wide variety of forms. For example, baseball, football, lacrosse, jai-alai and other sports all involve (among other things) the tossing of a ball or other article by one player, and the subsequent catching of that article by another player. However, most known tossing/catching games utilize unitary, generally homogenous tossing articles (e.g., balls), and therefore require catching of the article by encompassing it with the hands, glove or other implement (e.g., baseball glove, lacrosse stick).

SUMMARY OF THE INVENTION

The game apparatus of this invention includes two parts: a dual-bodied missile member which consists of two ball elements or other discrete masses connected to each other by a flexible strap portion, and a tossing-/catching implement or stick member which is used in launching and receiving the missile. The missile bodies are preferably identical to each other in size, shape, and weight, and may take the form of tennis balls, rubber balls, "Koosh Balls" (filamented balls manufactured by Oddzon Products), small dolls, or any other relatively small and tossable articles. The strap portion used to connect the missile bodies may be made of white suede leather, rubber, cord, or any other suitable flexible material.

The shape of the strap portion can be critical to the suitability of the missile for tossing and catching. In the preferred embodiment, the connecting strap comprises a bi-tapered, symmetrical (about the centerline) strap member having an overall length of approximately 24 cm., with a generally narrow center portion (e.g., 2 cm.), expanding to a pair of generally wider medial portions (e.g., 4 cm.), and then tapering to a pair of generally narrow distal portions (e.g., 2 cm.), ending in terminal portions which are inserted into or otherwise connected to each of the missile bodies. In horizontal cross-section, the strap member preferably has a generally thin center portion (e.g., 1.75 mm), a pair of generally thicker medial portions (e.g., 5.25 mm), and a pair of generally thinner distal portions (e.g., 1.75 mm) adjacent the terminal portions which are connected to the missile bodies. In this manner, the strap exhibits a naturally greater flexibility at the center and distal segments which are therefore both narrower in width and thinner in thickness than the adjacent (and intervening) medial portions, which arrangement is conducive for capture by the tossing/catching implement (described infra). This thickening can be accomplished in several manners, including simple cutting (with a homogenous material), multiple layering of a uniform-thickness material (e.g., gluing additional layers where needed), or application of a secondary material over the base strap.

This construction is designed to join the dual-bodied missile with a flexible strap that has resilience, and will be easy to catch either in the middle of the strap, or at either end by the tossing/catching implement or stick (the thin parts of the strap will drape easily over the tip of the launching stick, helping to provide for secure catches). The taper in the strap is also designed so that the launching stick will easily "find" the center of the strap, both when tossing and catching the missile (i.e., the strap will naturally tend to gravitate and move along the stick to the narrower/thinner parts of the strap—the center portion and distal portions). The strap is also designed so that when the missile is launched properly (with the strap center resting in the center of the tip of the launching stick), the two bodies of the missile will travel parallel and nicely spaced so that center of the missile's strap is easily visible to the catcher.

The design of the tossing/catching implement can similarly be critical to the efficiency of the tossing and catching of the missile. In the preferred embodiment, the tossing stick comprises an elongate stick member having a generally linear handle portion and terminating in a non-linear (angular or curved) missile capture portion. In the preferred embodiment, the stick member is approximately 72 cm. in overall length and 1.2 cm in thickness, with the capture portion comprising the terminal 12 cm. The capture portion is preferably angled approximately 45 degrees relative to the handle portion, and includes a tapered leading edge oriented in the direction of the angulation. The stick member may be made of fiberglass, plastic, wood, or any other suitable, generally rigid material.

DETAILED DESCRIPTION OF A PREFERRED EMBODIMENT

Figure 1:
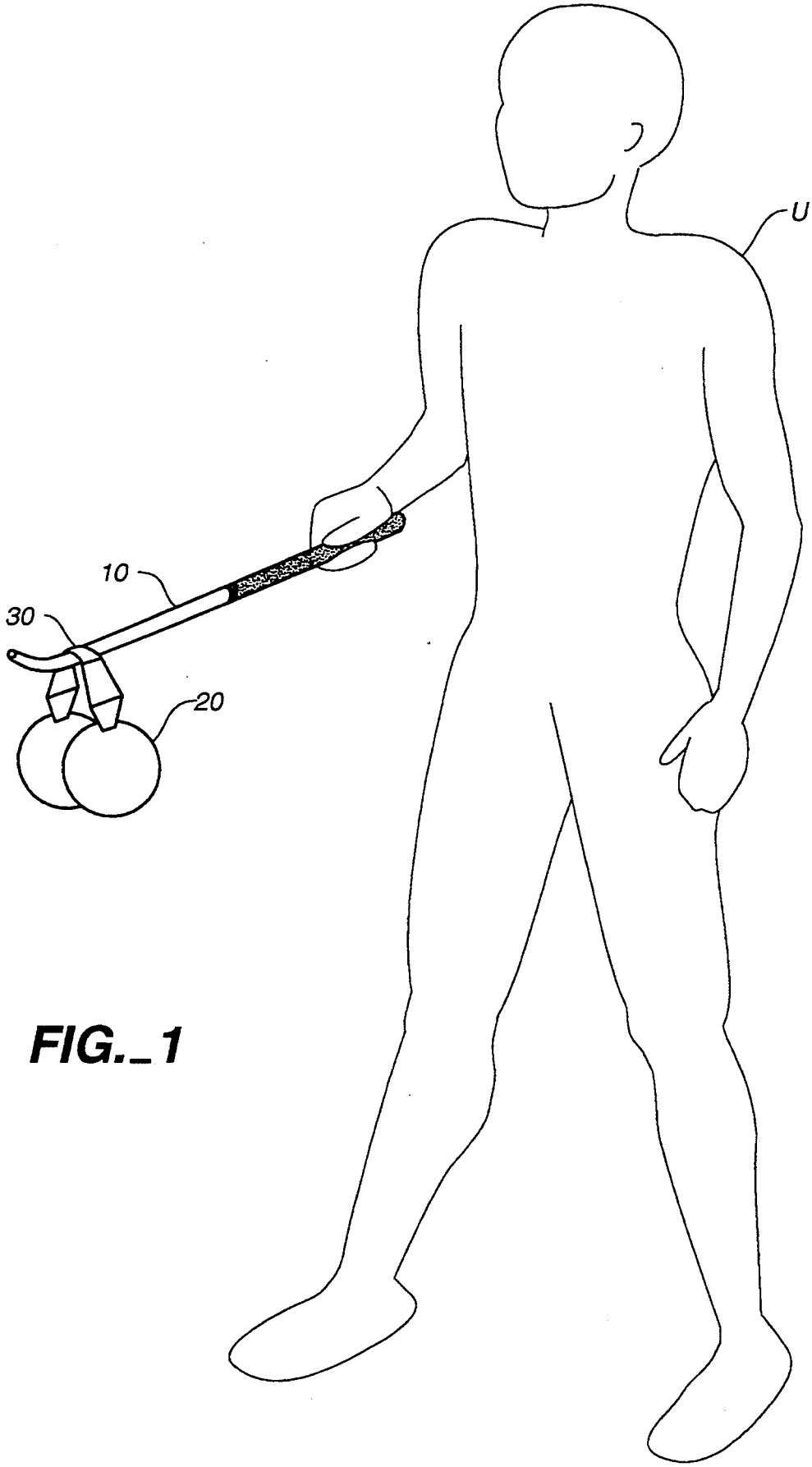
FIG. 1 is a pictorial perspective view of a user holding a tossing/catching implement and which is carrying a dual-bodied missile of the game apparatus of this invention.

FIG. 1 is a pictorial perspective view of a user U holding a tossing/catching implement 10 and which is carrying a dual-bodied missile 20 of the game apparatus of this invention. This view is illustrative of both the launching of the missile 20 from the implement (stick) 10, as well as the receiving of the missile onto the stick. This view demonstrates the natural tendency of the connecting strap 30 to be centered on the stick in use.

Figure 2:
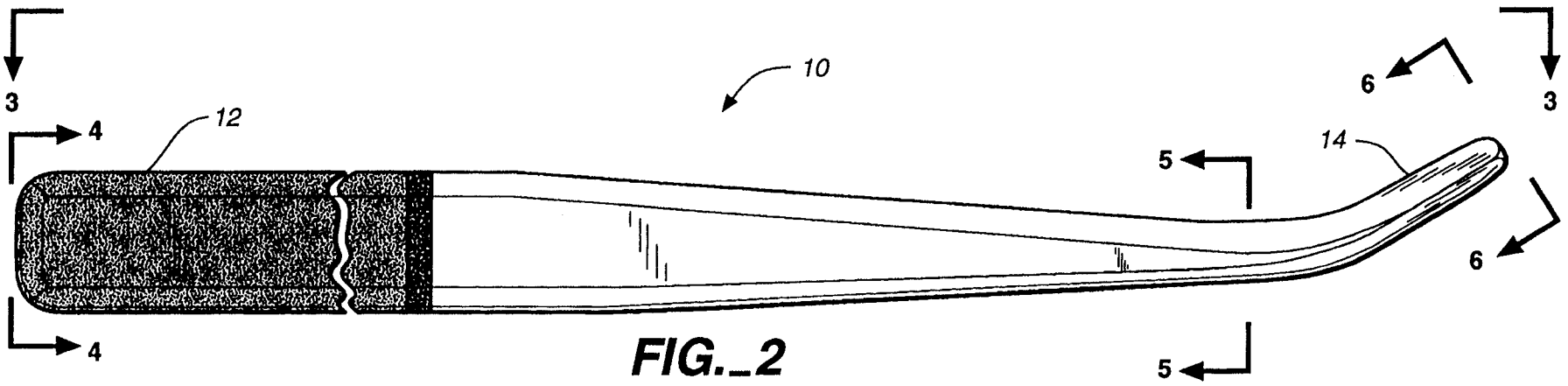
FIG. 2 is shortened side elevation view of a tossing-/catching implement of the game apparatus.

FIG. 2 is shortened side elevation view of a tossing-/catching implement 10 of the game apparatus. This view best illustrates that the tossing stick 10 comprises an elongate stick member having a generally linear handle portion 12 and terminates in a non-linear (angular or curved) missile capture portion 14.

Figure 3:
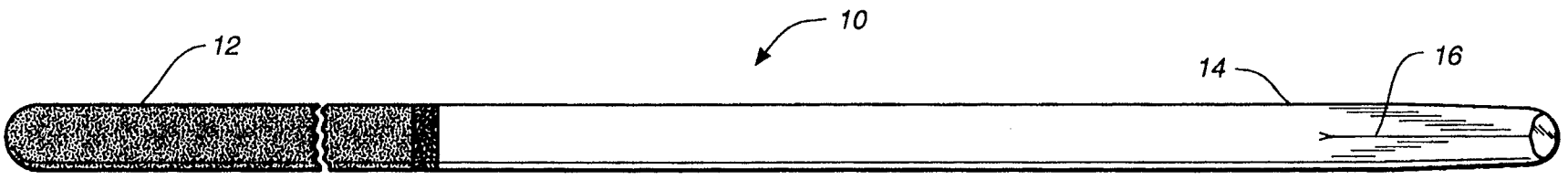
FIG. 3 is a shortened front elevation view of the tossing/catching implement of FIG. 2, this view taken along line 3—3 of FIG. 2.

FIG. 3 is a shortened front elevation view of the tossing/catching implement 10 of FIG. 2, this view taken along line 3—3 of FIG. 2. This view illustrates the preferred tapered leading edge 16 in the direction of the angulation of the missile capture portion 14.

Figure 6:
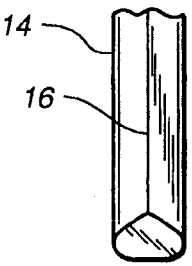
FIG. 6 is a bottom end view of the tossing/catching implement of FIG. 2, this view taken along line 6—6 of FIG. 2.
Figure 5:
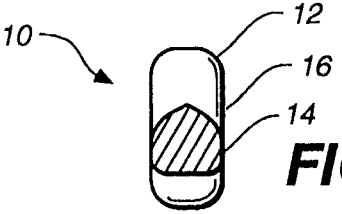
FIG. 5 is a medial cross-sectional view of the tossing-/catching implement of FIG. 2, this view taken along line 5—5 of FIG. 2.
Figure 4:
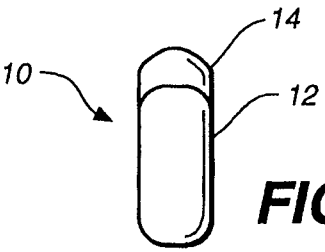
FIG. 4 is a top end view of the tossing/catching implement of FIG. 2, this view taken along line 4—4 of FIG. 2.

FIG. 4 is a top end view of the tossing/catching implement 10 of FIG. 2, this view taken along line 4—4 of FIG. 2; while FIG. 5 is a medial cross-sectional view of the tossing/catching implement 10 of FIG. 2, this view taken along line 5—5 of FIG. 2; and FIG. 6 is a bottom end view of the tossing/catching implement 10 of FIG. 2, this view taken along line 6—6 of FIG. 2. These views collectively illustrate the preferred tapering of the implement from the handle portion 12 to the missile capture portion 14. FIGS. 5 and 6 also illustrate the tapered leading edge 16 in the direction of the angulation of the missile capture portion, which taper is preferably presents an approximate 90 degree edge toward the leading edge (and against the missile's strap portion when captured there).

Figure 7:
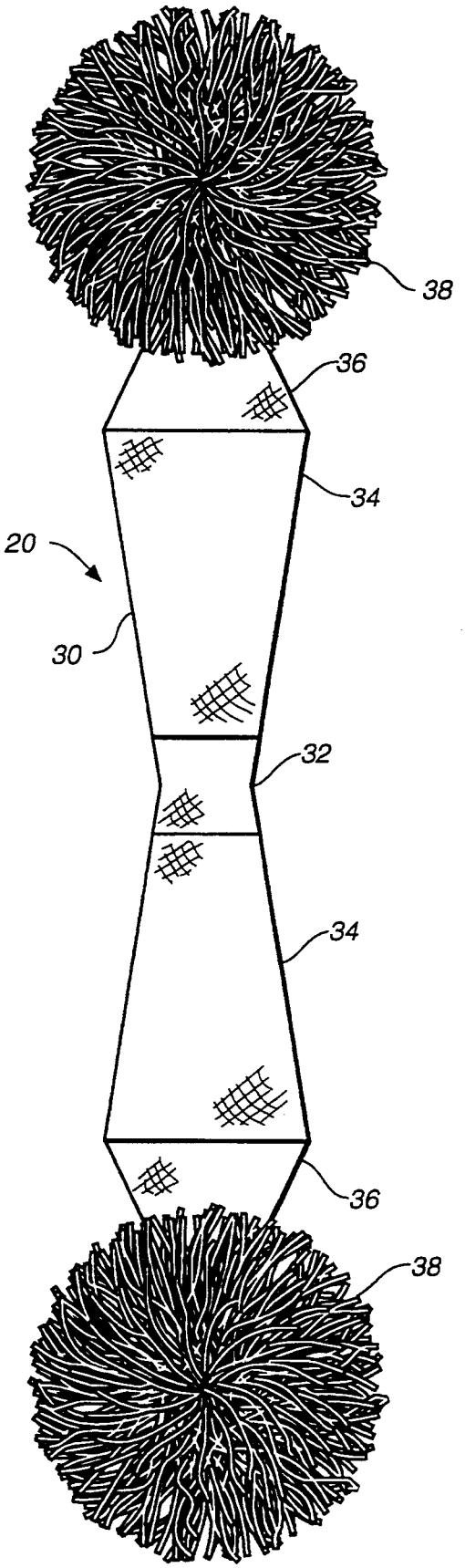
FIG. 7 is a top plan view of a filamented-ball embodiment of a dual-bodied missile of this invention.

FIG. 7 is a top plan view of a filamented-ball embodiment of a dual-bodied missile 20 of this invention. The connecting strap 30 comprises a bi-tapered, symmetrical (about the centerline) strap member having an overall length of approximately 24 cm., with a generally narrow center portion 32 (e.g., 2 cm.), expanding to a pair of generally wider medial portions 34 (e.g., 4 cm.), and then tapering to a pair of generally narrow distal portions 36 (e.g., 2 cm.), ending in terminal portions which are inserted into or otherwise connected to each of the missile bodies 38.

Figure 8:
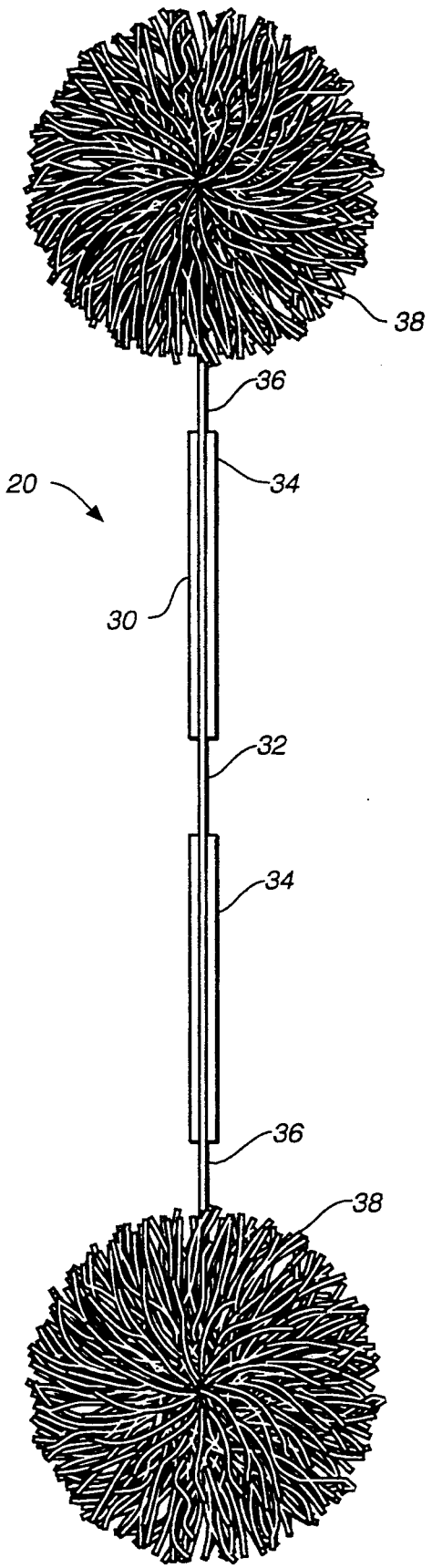
FIG. 8 is a front elevation view of the filamented-ball embodiment of the dual-bodied missile of FIG. 7.

FIG. 8 is a front elevation view of the filamented-ball embodiment of the dual-bodied missile 20 of FIG. 7. In horizontal cross-section, the strap member 30 preferably has a generally thin center portion 32 (e.g., 1.75 mm), a pair of generally thicker medial portions 34 (e.g., 5.25 mm), and a pair of generally thinner distal portions 36 (e.g., 1.75 mm) adjacent the terminal portions which are connected to the missile bodies 38.

Figure 9:
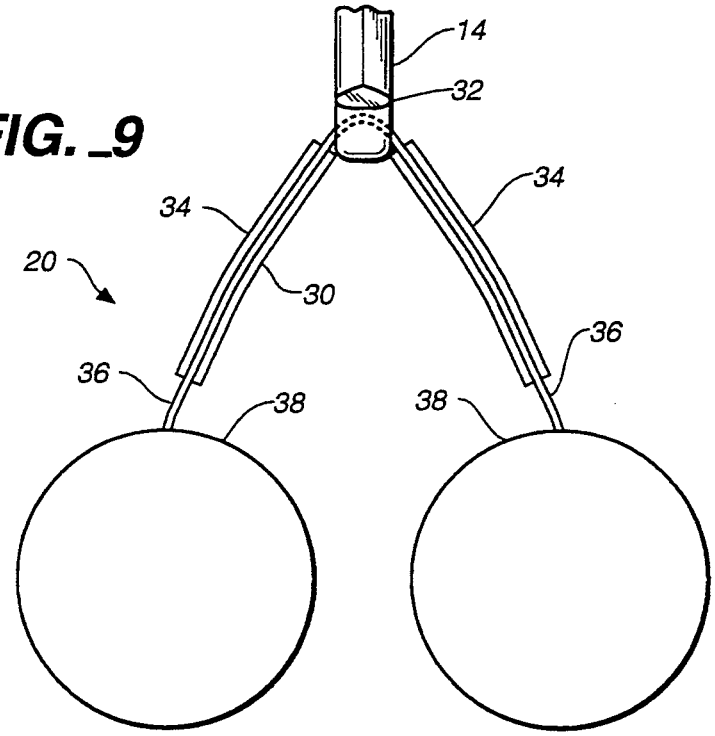
FIG. 9 is a front elevation view of a round ball embodiment of a dual-bodied missile of this invention as captured by its connecting strap center portion on the capture portion of a tossing/catching implement.
Figure 10:
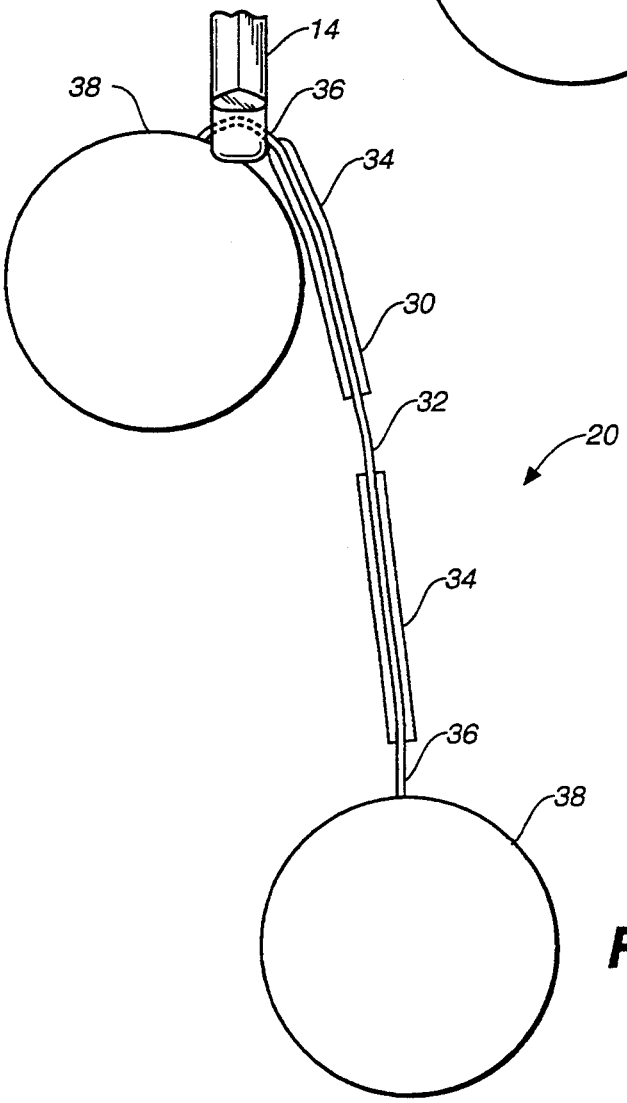
FIG. 10 is a front elevation view of the round ball embodiment of the dual-bodied missile of FIG. 9 as captured by one of its connecting strap distal portions on the capture portion of a tossing/catching implement.

FIG. 9 is a front elevation view of a round ball embodiment of a dual-bodied missile 20 of this invention as captured by its connecting strap center portion 32 on the capture portion 14 of a tossing/catching implement, while FIG. 10 illustrates capture by one of the missiles connecting strap distal portions 36 on the capture portion 14 of a tossing/catching implement. In use, the strap will naturally tend to gravitate and move along the capture portion of the stick to the narrower/thinner parts of the strap, i.e., the center portion 32 and distal portions 36.

Variations for the missile bodies, and their preferable methods for attachment to a connecting strap include:

A. Ordinary tournament tennis balls.

Method for attaching tennis ball to strap:

1. Cut a slit in ball with a sharp knife equal to width of end of strap.
2. Glue a wide strip of leather to each end section of strap, thus increasing thickness.
3. Coat thickened end of strap with adhesive and also smear some adhesive around mouth of slit (squeeze ball to open slit).
4. Insert adhesive end of strap into opened slit with tweezers.
5. Release pressure on ball and pull strap so that end fits snugly against inside wall of ball.

B. Ultra Koosh Balls of bright, warm colors of Oddzon Products.

Method for attaching koosh ball to strap:

1. Use Ultra Koosh ball. Snip loops used to hold tag. Try to maintain filament length.
2. Be sure Koosh ball is free of grease. If in doubt, wash with soap and warm water, rinse thoroughly and dry.
3. Nestle end of strap into and among the filaments. Filaments should extend 3 cm up alongside the strap. Remove strap.
4. Coat both sides of the 3 cm long end of strap with adhesive.
5. Separate filaments for inserting coated strap. Introduce strap until end rests against core of ball. Press filaments against strap. Use broad clamp to hold filaments against both sides of strap for eighteen hours.

C. Treasure Trolls of Ace Novelty Co.

Method for attaching Treasure Trolls:

1. Push the hair aside and use a sharp knife to cut a slit in the middle of the heads.
2. Apply adhesive to the tips of strap.
3. Insert tips of strap into slits using tweezers.
4. Total length of strap and attached trolls should be approximately 35 cms.
5. Allow eighteen hours for adhesive to set.

D. High Bounce Balls.

Method of attaching Bounce ball:

1. Use two balls 4.2 cm to 5.5 cm diameter.
2. Slice each ball in half. Cut a shallow channel in each slice half for insertion of the 3 cm end section of strap.
3. For each ball, treat end of strap, both sides, with adhesive. Treat cut surface of ball with adhesive.
4. Place strap end in channel of one ball half. Superimpose other ball half onto ball half with strap in perfect alignment in the channels.
5. Press halves of ball together, and use a clamp to hold the halves with strap end together. Allow 24 hours for join to set.

Typical guidelines for use of the game apparatus of this invention (referred to as "Two-Fly" for convenience) include the following:

Having Fun with Two-Flys

Note: When tossing the Two-fly, drape it over the Two-fly stick, slide it down toward end or stick and toss it underhand.

Game I. Solo (one person) "Juggling"

1. Standing or sitting, hold a Two-fly stick in each hand. Pick up a Two-fly with right Two-fly stick and toss it to drape over left Two-fly stick.
2. Now reverse direction. Be sure to arrange Two-fly on stick before tossing so that stick supports the strap midway between the weights and toward the far end of the stick.
3. Continue for nine more round trips (a total of twenty tossed). How many tosses were successful?
4. Invite others to try to beat your score.

5. Variation: Use a different design for every four round trips.

Game II. Solo ("Shooting baskets" or into a box or bucket.

Procedure:

1. With a Two-fly stick fixed at an angle to an upright object, draw a line ten feet from stick. Stand behind line and toss Two-flys of different designs to hand and collect on fixed stick.
2. How many Two-flys stayed on fixed stick?
3. Invite others to try to beat your score.
4. Variation: draw a line five feet or more beyond line first drawn, and repeat tosses.
5. Shoot Two-flys into a box or bucket.

Game III Several players (Circle Toss) Outdoors or in a gymnasium.

1. Arrange a circle of three or more players eight feet apart. Each player is provided with a Two-fly stick. At first, start with one Two-fly. Player A tosses Two-fly by stick to player B who attempts to catch it by stick. If successful, both player A and B receive one point. If toss is unsuccessful, neither player gets points. Game continues by player C tossing Two-fly to player C and planer C tossing to player A, then nine more rounds.
2. Which player has accumulated the most points?
3. Variations:
   A. After first Two-fly is started by player A, A may introduce and add to circle toss a second Two-fly of different design, and later still others.
   B. By making circle larger so that tossers can toss Two-flys above heads of catchers, so that catcher must reach up for them, two points may be given to tosser and catcher. Note: this provides the most exciting kind of catch: overhand tossing may be attempted.
   C. Reverse direction of play, e.g., A to C, C to B, B to A.

Game IV, two teams, "Volley Two-fly".

Needed: a volleyball court or a court of thirty or so feet plus 2, 7 ft. uprights across center of court with a rope between them, if a net is not available. Teams to be of three players or more each. Each player is provided with a Two-fly stick with a blunt end so as to prevent injuries to heads. Tennis ball and marbleized bounce ball Two-flys will bounce when Two-fly strikes court floor. Game is much like volleyball, that is if Two-fly lands on floor of court instead of being scooped up and returned by a member of opposing team, the serving team of that toss receives a point, unless the Two-fly bounces and is scooped up and returned, then game continues with no penalty. Team with twenty-one points wins match. Team members take turns serving-Two-fly must pass over top. If not, it forfeits serve or gives opposing team a point. No player may pick up Two-fly by hand during play. Only Two-fly stick may be used. Failure forfeits serve or give opposing team one point.

Note: This can also be played by circles of players, instead of two lines.

Needed: Players for two teams, each with Two-fly stick, and two Two-flys of same design. Designated court with goals for both teams at one end.

At signal "go" number ones of both teams start by tossing two-fly to number twos, the twos to threes and so on until goalie of winning team receives its Two-fly. If Two-fly falls to the ground, it must be scooped up only by a Two-fly stick. No team member may run. All members of both teams must remain in line in designated space.

Variations:

1. Hockey Two-fly - very active! Like above, except only one team (X) determined by flipping a coin starts toward their goal. Opposing team attempts to interrupt or intercept tosses. An intercepted toss with enable opposing team (0) to toss toward their goal. A score is made when Two-fly hits the ground in the scoring zone.

If Two-fly passes into scoring zone, 0 goalie may catch it on his Two-fly stick and attempt to toss it to an 0 player, thus allowing team 0 to posses the Two-fly and start it toward their scoring zone (opposite to that of team X).

Players can walk, but not run. Goalies can run, but must remain within their scoring zone. Players must not enter scoring zone.

Optional: A bouncing Two-fly may permit any player or goalie to retrieve it on his stick, thus reversing possession of the Two-fly.

Game time: thirty minutes (two halves of fifteen minutes).

Caution must be exercised at all times to avoid injuries (especially the eyes). Blunt-ended Two-fly sticks must be used.

Game IV. With the bouncer and the Two-fly launching stick:

A. The bouncer Two-fly can be used in games described above.

B. The bouncer should definitely be used on a hard surface. If inside, hardwood floor, linoleum, tile, concrete, or flat ground.

Additional action:

With Two-fly bouncer held on end of launching stick by center of strap, toss it straight up and let it fall to the ground of floor. Catch it with stick on the bounce. It can be caught with stick either in strap center, or either flexible end.

Shift Two-fly strap from central position on stick to flexible strap end as shown below. When tossed, the Two-fly will now fly end over end before it bounces.

With a partner: Toss the Two-fly toward him, but allow it to fall to the floor in front of him, so he can catch it on the bounce. Use either C or D position of strap on stick.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A game apparatus comprising:

a dual-bodied missile member consisting of two body elements connected to each other by a flexible strap portion comprising a bi-tapered, symmetrical strap member with a generally narrow center portion, expanding to a pair of generally wider medial portions, and then tapering to a pair of generally narrow distal portions, and ending in terminal portions which are connected to each of said missile bodies; and a tossing/catching implement to launch and receive said missile.

2. The game apparatus of claim 1 wherein said missile body elements are identical to each other in size, shape, and weight.

3. The game apparatus of claim 1 wherein said tossing/catching implement comprises an elongate stick member having a generally linear handle portion and terminating in a non-linear missile capture portion.

4. The game apparatus of claim 3 wherein said capture portion is angled approximately 45 degrees relative to said handle portion.

5. The game apparatus of claim 4 wherein said capture portion includes a tapered leading edge in the direction of the angulation.

6. A game apparatus comprising:

a dual-bodied missile member consisting of two body elements connected to each other by a flexible strap portion comprising a bi-tapered, symmetrical strap member having a generally thin center portion, a pair of generally thicker medial portions, and a pair of generally thinner distal portions adjacent terminal portions which are connected to said missile bodies; and a tossing/catching implement to launch and receive said missile.

7. The game apparatus of claim 6 wherein said missile body elements are identical to each other in size, shape, and weight.

8. The game apparatus of claim 6 wherein said tossing/catching implement comprises an elongate stick member having a generally linear handle portion and terminating in a non-linear missile capture portion.

9. The game apparatus of claim 8 wherein said capture portion is angled approximately 45 degrees relative to said handle portion.

10. The game apparatus of claim 9 wherein said capture portion includes a tapered leading edge in the direction of the angulation.

* * * * *